US007598916B2

(12) United States Patent
Inbal et al.

(10) Patent No.: US 7,598,916 B2
(45) Date of Patent: Oct. 6, 2009

(54) QUICK DEPLOYED ANTENNA SYSTEM

(75) Inventors: Noam Inbal, Shoham (IL); Nimrod Farjoun, Karkur (IL)

(73) Assignee: Gilat Satellite Networks Ltd. (IL)

( * ) Notice: Subject to any disclaimer, the term of this patent is extended or adjusted under 35 U.S.C. 154(b) by 84 days.

(21) Appl. No.: 11/876,072

(22) Filed: Oct. 22, 2007

(65) Prior Publication Data

US 2008/0117112 A1 May 22, 2008

Related U.S. Application Data

(60) Provisional application No. 60/853,445, filed on Oct. 23, 2006.

(51) Int. Cl.
*H01Q 1/12* (2006.01)
*H01Q 1/08* (2006.01)

(52) U.S. Cl. ..... 343/718; 343/881

(58) Field of Classification Search ..... 343/718, 343/878, 881
See application file for complete search history.

(56) References Cited

U.S. PATENT DOCUMENTS 5,760,751 A 6/1998 Gipson
6,742,684 B2 * 6/2004 Oh ..... 224/153
7,028,873 B1 * 4/2006 Collier et al. ..... 224/628
7,218,289 B2 * 5/2007 Trajkovic et al. ..... 343/882
2004/0088780 A1 5/2004 Bachar

FOREIGN PATENT DOCUMENTS

EP 0181221 5/1986
EP 0293877 12/1988

OTHER PUBLICATIONS

Patriot: 1.Om Back-pack Flyaway Systems, XP002467363, URL:http:www.sepatriot.com/PDF/10_BackPaack.pdf, retrieved on Feb. 4, 2008.
EP 07254199, European Search Report, dated Feb. 4, 2008.

* cited by examiner

*Primary Examiner*—Shih-Chao Chen
(74) *Attorney, Agent, or Firm*—Banner & Witcoff, Ltd.

(57) ABSTRACT

A satellite system is packed into and transported via a backpack whereby the backpack integrally accommodates and supports the satellite antenna system as a single unit. The satellite antenna system expands or telescopes from the backpack as a complete working unit without the assembly of parts or minimal assembly such as the connection of cables. The backpack itself becomes the base to support the satellite antenna system in a stable position.

22 Claims, 17 Drawing Sheets

QUICK DEPLOYED ANTENNA SYSTEM

FIELD

Illustrative aspects of the invention relate to quick deployed antenna systems, and, in particular, to systems deployed from backpacks.

BACKGROUND

Portable antenna systems are known, but can be particularly cumbersome to actually tote around. Such systems are typically packed in cases that are used for transportation and require an assembly of parts. In such situations, the case may be used as the base for the assembled antenna.

Such cases either have wheels or require a transport device such as a wheeled cart which may be pulled or pushed. However, such cases are not effective when the antenna system must be taken over rough terrain.

Another approach has been to carry the antenna system parts in a backpack to the desired destination and then assemble the parts at the destination location. Assembly and disassembly are time consuming processes and there is always the danger of missing or forgotten items.

It is desirable to have an antenna system that can be easily carried and at the same time quickly and easily deployed for use.

SUMMARY

An illustrative aspect of the invention includes a backpack containing a quick deployed antenna system.

In accordance with one aspect, a quick deploy antenna system comprises, in combination a backpack body being wearable in a vertical position, the backpack body having an interior compartment; and leg assemblies extendible from the backpack body and extendible to a surface when the backpack is in a horizontal position, and a deployable antenna system contained within the interior compartment; wherein the antenna system is connected to the interior compartment and is extendible from the interior compartment into a fully deployed condition.

Another aspect of the invention is directed to a method of deploying an antenna system from a backpack body, the backpack body having an interior compartment and leg assemblies extendible from the backpack body to a surface when the backpack is in a horizontal position, wherein the antenna system is connected to the interior compartment, the method comprising placing the backpack in a horizontal position on the surface, and deploying the antenna system from within the interior compartment.

BRIEF DESCRIPTION OF THE DRAWINGS

Illustrative aspects of the invention will be described in detail with reference to the following figures in which like elements are labeled with like numbers and in which.

The figures referred to above are not drawn necessarily to scale and should be understood to provide a representation of the invention, illustrative of the principles involved.

DETAILED DESCRIPTION

Illustrative aspects of the invention will be described in detail below with reference to the accompanying drawings. These aspects merely provide examples of the invention, and it is needless to say that the aspects can be suitably modified without departing from the gist of the invention.

Backpacks typically comprise a large central compartment into which the items are placed. Additional compartments may also be provided to separate items within the backpack, and external pockets may be provided to provide additional storage. The backpack is typically outfitted with a pair of shoulder straps, and may also have a hip strap, each of which are attached to the backpack and are used by the wearer to carry the backpack According to aspects of the invention, a satellite system is packed into and transported via a backpack whereby the backpack integrally accommodates and supports the satellite antenna system as a single unit. The satellite antenna system expands or telescopes from the backpack as a complete working unit without the assembly of parts or minimal assembly such as the connection of cables. The components of the satellite system are connected with hinges, for example, such that no parts are lost and the satellite system is easily deployed. Moreover, the backpack itself becomes the base to support the satellite antenna system in a stable position.

Figure 1:
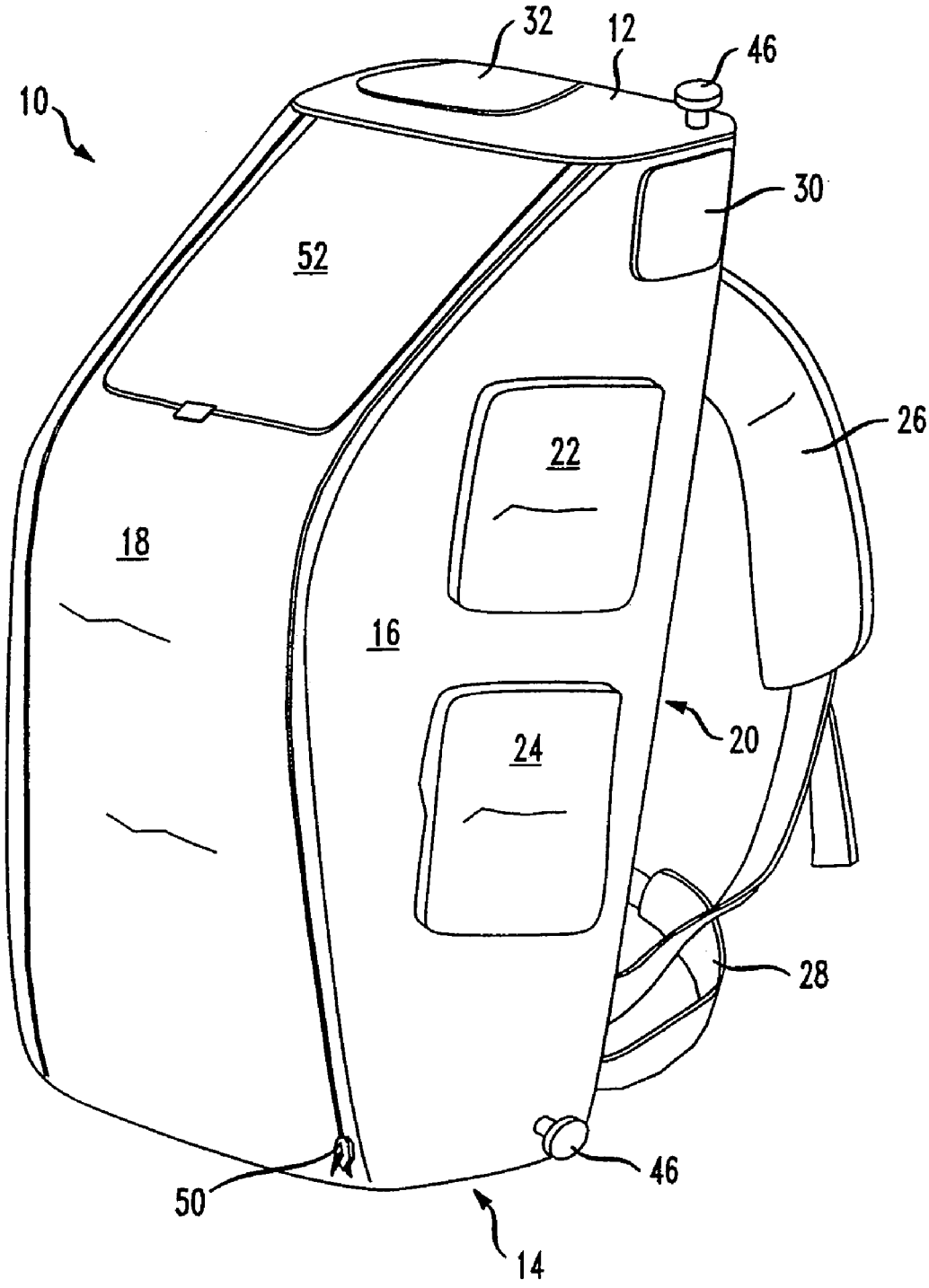
FIG. 1 depicts a backpack for a satellite system in accordance with an aspect of the invention.
Figure 2:
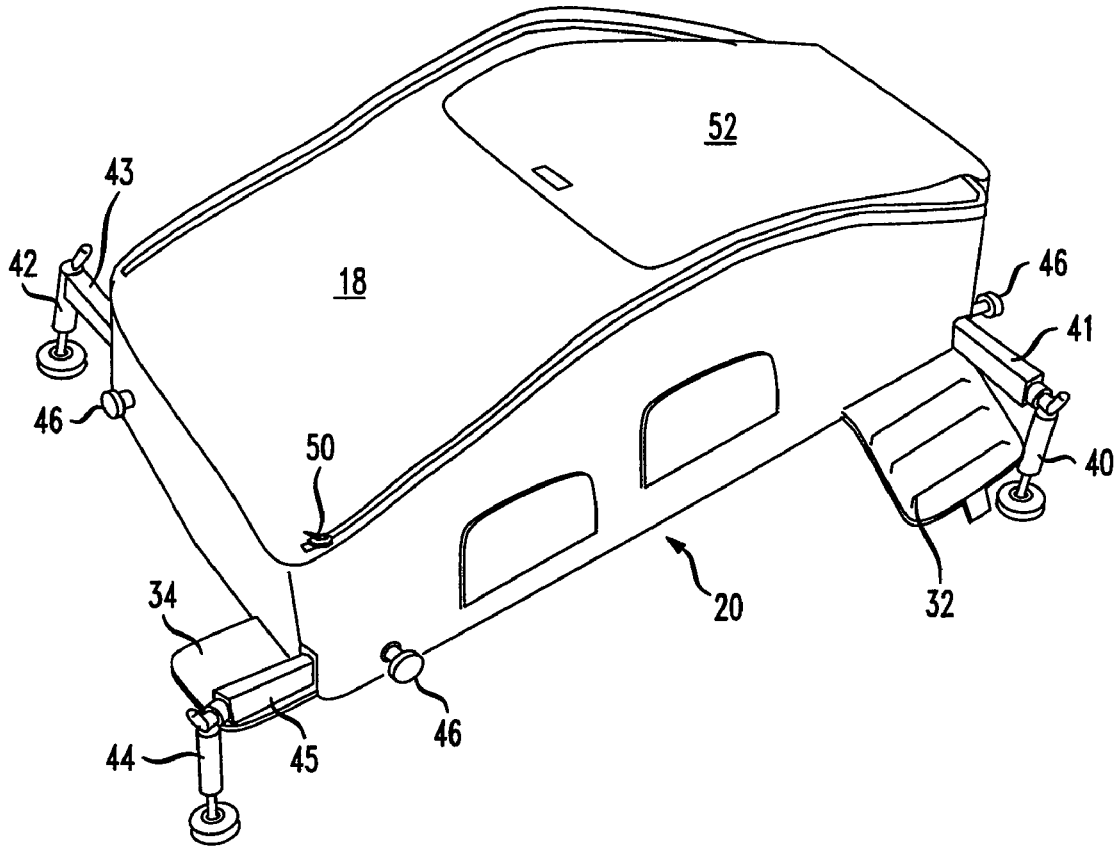
FIG. 2 depicts the backpack of FIG. 1 in a horizontal position in accordance with an aspect of the invention.

Attention is drawn to FIG. 1 showing a backpack in the vertical position as used when a wearer is carrying the backpack. Backpack 10 is formed of a plurality of panels, including a top 12, a bottom 14, two lateral sides 16, an outer side 18, and a body support side 20. When used herein, the term "outer side" refers to the side of the backpack, or any other element, that faces away from the back of the user wearing the backpack. Accordingly, the term "support side" refers to the side of the backpack, or any other element, that faces the back of a user. As shown in FIG. 2, when the backpack is not being carried, but is being used for deployment of the satellite antenna system, the backpack is in the horizontal position with the support side 20 adjacent to the surface such as the ground. The support side is the bottom of the support for the antenna system.

When connected, the six panels or sides define an interior compartment 48 in backpack 10 in which a satellite antenna system is located. See FIG. 3. The interior compartment 48 of backpack 10 may be subdivided into smaller compartments, and external pockets, e.g. 22, 24, may be added in order to keep various items separate from one another, thereby providing easy access to the items, and allowing for the proper weight distribution and comfort to the wearer.

Although six particular sides or panels are described, backpack 10 can comprise fewer or more panels or sides, and be within the scope of the invention. For instance, each of the body, top, bottom, outer, and lateral sides can be comprised of one continuous piece of fabric with no actual seams or junctures. Alternatively, backpack 10 could even be formed with ten or more panels or sides and corresponding seams or junctures therebetween.

The panels making up backpack 10, as well as the straps and other components of the invention, can variously comprise a number of natural or synthetic materials. Natural fabric such as leather, cotton (especially canvas or single-filled duck) and the like may be useful for certain applications. Exemplary materials are synthetic fabrics made from thermoplastic materials such as polypropylene, polyvinyl chloride, polyamide (such as nylon), polyethylene, polyester, etc. In certain preferred embodiments, nylon is used, which can be textured for breathability, wear-resistance, and waterproofed with materials such as silicone elastomers and the like. Multiple or composite layer configurations as are well-known in the art, in which a tougher, more durable weave comprises an outer layer while a lighter, thinner, and more flexible inner weave comprises an inner layer.

Each of a pair of shoulder straps 26 is secured at first and second ends thereof to backpack 10. Shoulder straps 26 may have an adjustable buckle (not shown). In a preferred embodiment, a hip strap 28 is secured at opposite ends thereof to backpack 10. Hip strap 28 typically comprises left and right side portions, connected to one another by an adjustable buckle (not shown).

As shown in FIG. 2, the backpack forms a base support for the antenna system. FIG. 2 shows body side 20 positioned horizontally against a ground surface. Four leg assemblies extend from the backpack, each leg assembly extending in a different direction and extending from a different side of the backpack. Four leg assemblies are suitable for the rectangular shape/frame. As shown in FIG. 2, the leg assemblies comprise extension bars 41, 43, and 45 which extend horizontally from the backpack and leg supports 40, 42, and 44 connected vertically to the end of the extension bars, respectively. The leg supports rest on the ground in such a manner to support the backpack in the horizontal position. Individual leg extension locks 46 lock the extension bars in an operating or stowage position.

In FIG. 1, the leg assemblies (extension bars and leg supports) are in a retracted or stowage position and covered with flaps such as 30 and 32. The flaps may be closed by any suitable means such as VELCRO, snaps, buttons, or zippers.

The extension bars may be extended and retracted from the backpack by any suitable system such as with tracks and slides. The extension bars are connected to the leg supports in any suitable manner such as hinges to allow the leg supports to fold against the extension bar and to unfold from the extension bar to an approximately 90 degree angle. The leg supports may be of an adjustable thread design in order to adjust the height of each leg. This allows the backpack to be set on uneven terrain, but still provide a stable support for the antenna system.

The leg supports may also be adapted to anchor into the ground similar to a tent stake to provide additional stability. Alternatively, a piton and cable system may be used to anchor the backpack to the ground, again similar to anchoring a tent to prevent the backpack from moving or tilting during use of the satellite system.

The backpack may further have wheels (not shown) attached to the backpack structure or have removable wheels that may be easily attached and unattached. The wheels may be part of the leg assembly and rotate into position when required, but otherwise fold away. The wheels may be any suitable type of wheel such as cart wheels or dolly wheels.

A means to enclose the interior compartment 48 of the backpack, for example zipper 50, is present along the peripheral edge of the outer side 18. Any suitable means to enclose the backpack may be used such as zippers, VELCRO, straps, snaps, buttons, and the like.

Figure 3:
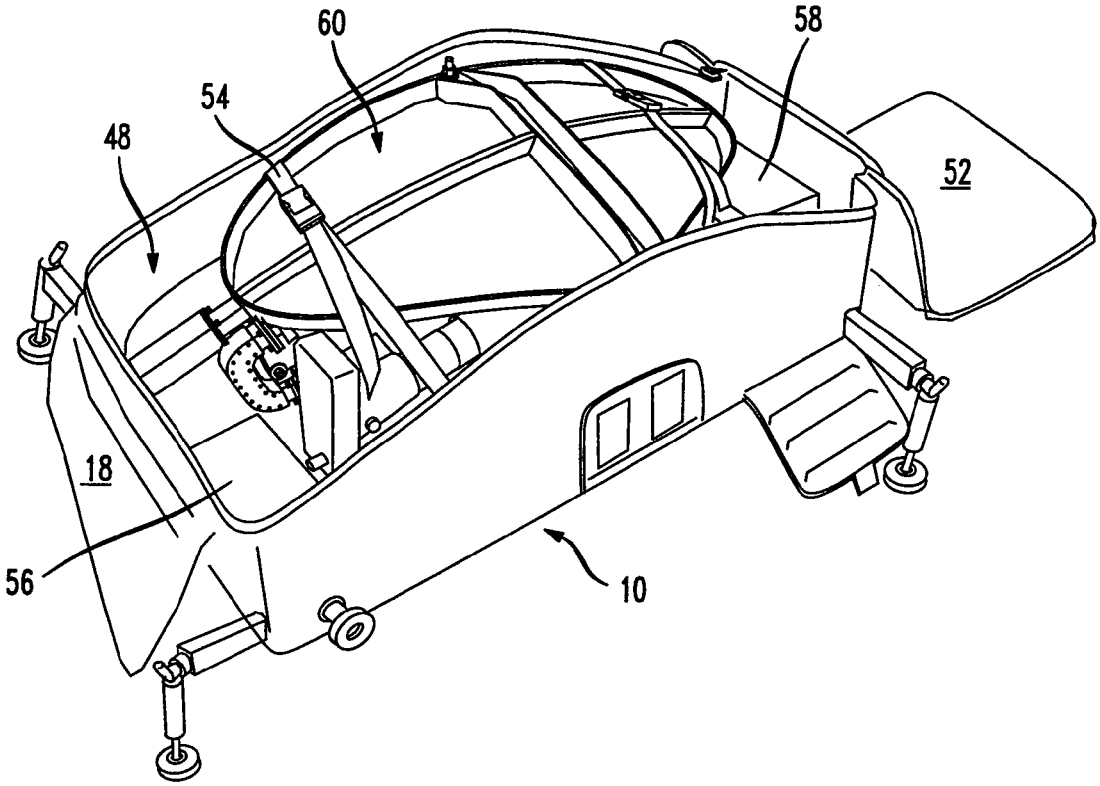
FIG. 3 depicts the backpack of FIG. 2 in an open position in accordance with an aspect of the invention.

FIG. 3 shows flap 52 and outer side 18 opened to reveal the interior compartment 48 of the backpack. Inside the backpack 10 is a satellite antenna system 60 that is attached to the backpack 10 but may telescope or extend out from the backpack. The antenna system may be held in place in the interior of the backpack by one or more straps 54.

The interior compartment 48 may also contain one or more pockets or smaller compartments, e.g. 56, 58, built into the backpack to hold parts of the antenna system such as a power source, computer, and the like. These pockets or compartments may have openings to attach cables or wires through the compartment or for access to knobs, switches, and other operating devices. The compartments may have openings to insert and remove the power source, for example, and flaps with, for example VELCRO, to maintain the flap in a closed position.

The antenna system is supported by a rectangular or other suitable shaped frame at the bottom of the interior of the back pack—the bottom being the inside of the support side 20 of the back pack. The frame may be made of aluminum or any other suitable, typically strong but lightweight material. The antenna system including the VSAT are mounted on the frame and wrapped with fabric, in some areas double layer with protecting foam in between. The frame is hollow and each side of the frame accommodates an extension bar of a leg.

A pocket or smaller compartment inside or outside the backpack may contain suitable accessories for aligning and operating the system, for example a keyboard. Such accessories may be removed for use or operated through openings in the pocket or compartment. The accessories may be attached to a computer, for example, for operation of the satellite system.

Figure 4:
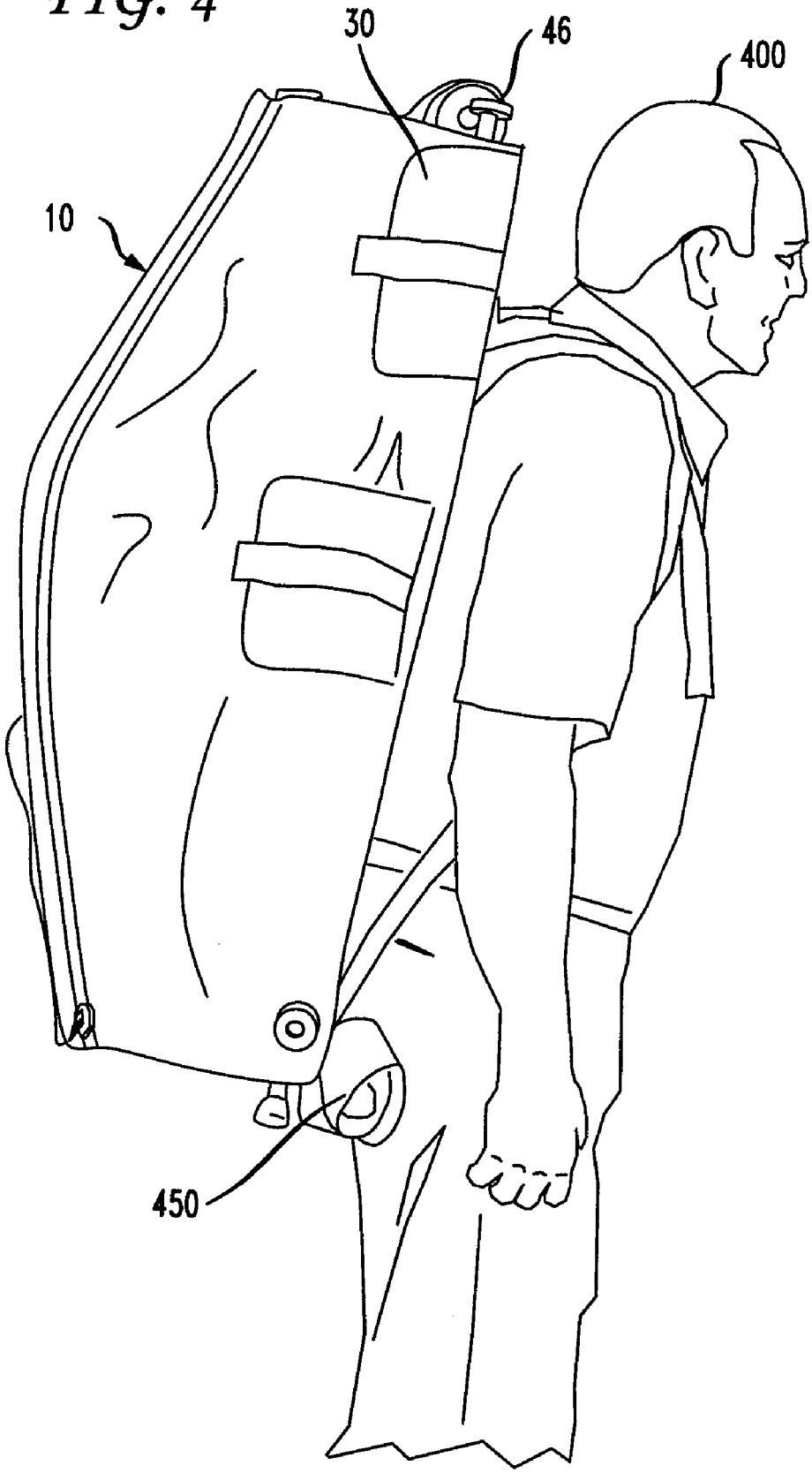
FIG. 4 depicts a backpack for a satellite system being worn by a person in accordance with an aspect of the invention.

FIG. 4 shows the backpack 10 in the carrying position by a person 400. The leg assembly is in an unextended and rotated or "stowage" position and covered by a flap 30. Also shown is a leg extension lock 46 to lock the extension bar when in the extended operating position or in the stowage position. (See extension bar 41 for example in FIG. 2.) The lock may operate by turning the knob or by pushing and pulling the knob depending how the leg extension lock is connected to the extension bar.

Also indicated is rolled-up protecting cover 450 for the shoulder and waist straps. Before setting the backpack on its legs in a horizontal position, the protecting cover is unrolled and then extended over the shoulder and waist straps to protect the straps and support side from dirt and damage from placement adjacent the ground. The cover is then attached to the support side of the backpack by any suitable means, typically a zipper, VELCRO, buttons, or snaps.

Figure 5:
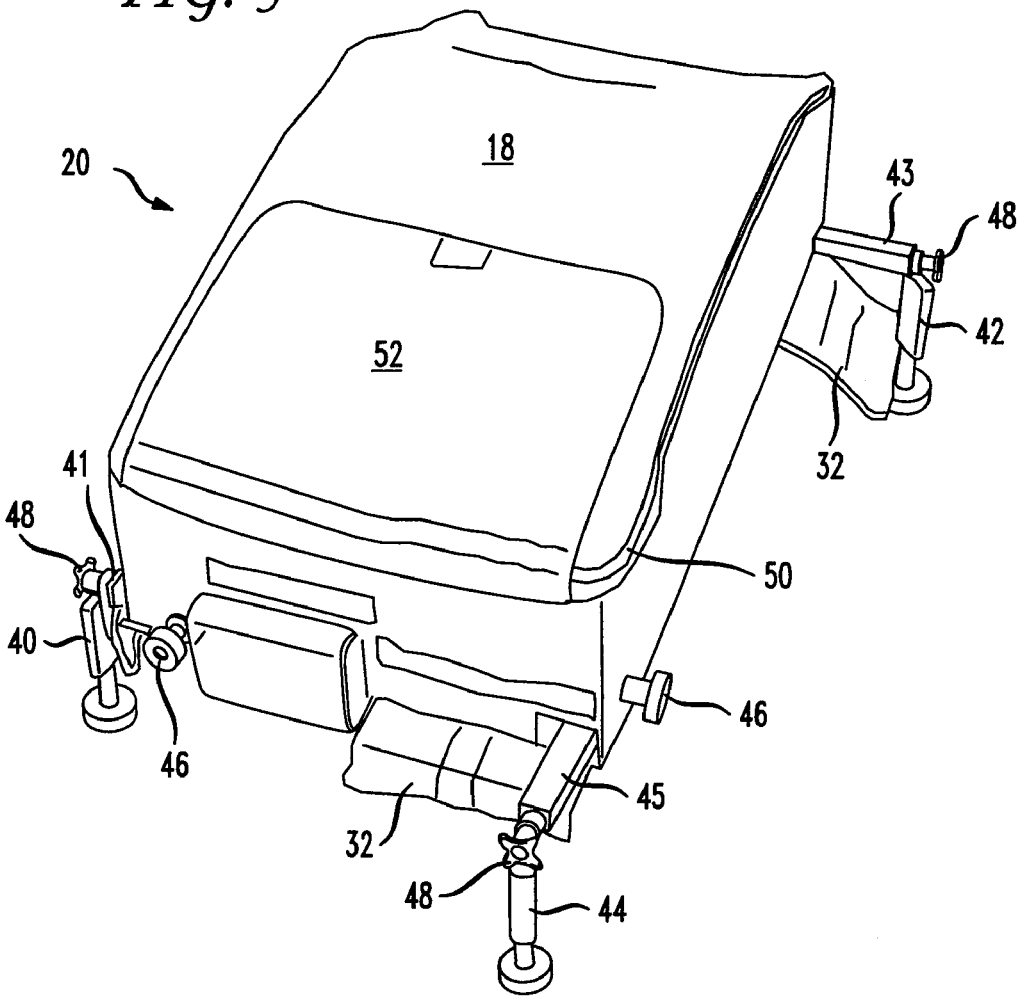
FIG. 5 depicts a backpack for a satellite system having extended leg assemblies in accordance with an aspect of the invention.

FIG. 5 shows a perspective view of the top of the backpack with the leg assemblies in an extended or unextended and locked position. Extension bars 43, 45 are extended horizontally from the backpack whereas extension bar 41 is not extended. Each of the extension bars may also be partially extended. Leg supports 40, 42, 44 are rotated vertically to reach the floor. Each vertical leg is adjustable using leg position locks 48 in order to level the back pack. The leg position lock locks the leg supports in a vertical operating position (as shown) or in a horizontal stowage position. Leg extension locks 46 lock the extension bars in place.

Figure 6:
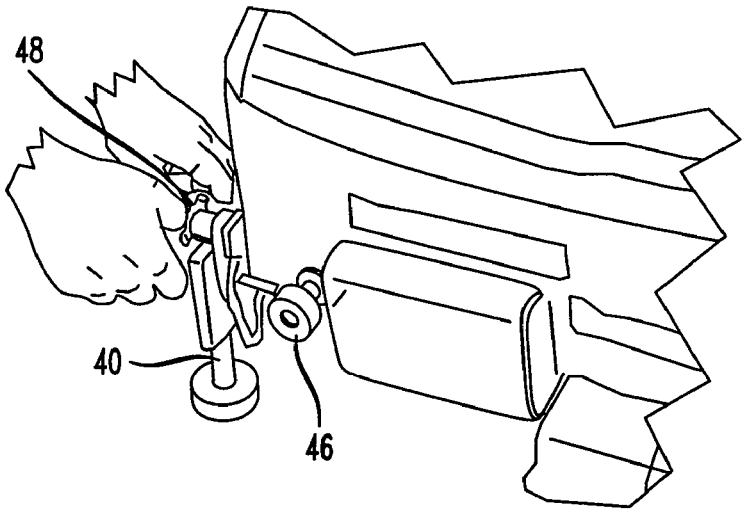
FIG. 6 depicts a corner of backpack with an extended leg assembly in accordance with an aspect of the invention.

FIG. 6 shows the leg lock 48 locking leg support 40 in the vertical (operating) position. The leg lock is typically rotated to lock or unlock the leg support. FIG. 6 also shows the extension bar lock 46 to lock the extension bar 41 in a partially extended or fully extended operating position or in a retracted (unextended) position against the backpack. The leg support height may be adjusted by any suitable means, typically a threaded fastener.

Figure 7:
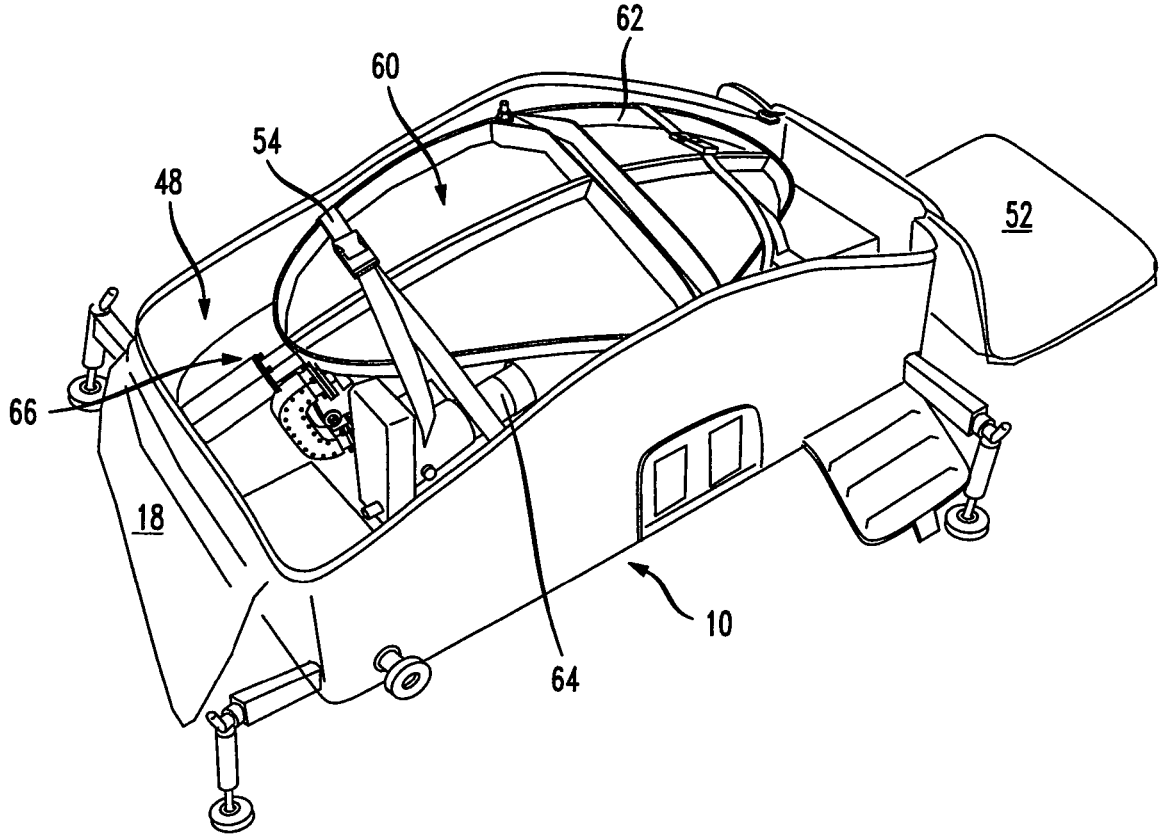
FIG. 7 depicts a backpack in a horizontal position having a satellite system folded therein in accordance with an aspect of the invention.

FIG. 7 shows the backpack 10 positioned on four legs with flap 52 open and outer side 18 unzipped and in an open position similar to FIG. 3. Flap 52 and outer side 18 are opened to reveal the interior compartment 48 of the backpack. Inside the backpack is a satellite antenna system 60.

The antenna reflector 62 is particularly secured by straps 54 in the interior of the backpack to prevent movement while the antenna system 60 is being carried in the backpack by the wearer. The antenna reflector 62 may be a single piece or two or more pieces. The two or more pieces may unfold from the backpack to form the antenna reflector and may or may not be connected together. If connected, suitable connectors include, but are not limited to hinges. Also shown is pole 64 used to vertically extend satellite reflector 62 and ODU/LNB (transmitter/receiver) 66.

Figure 8:
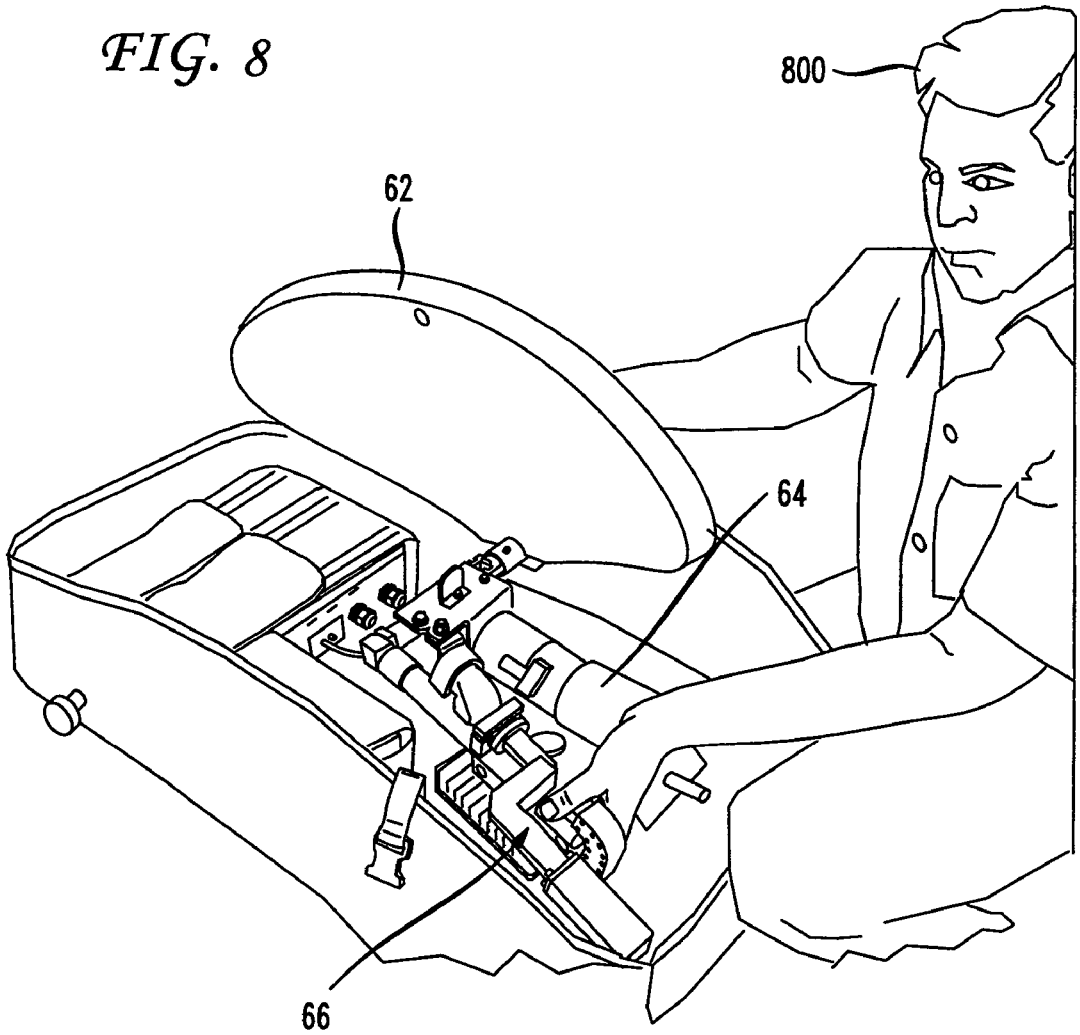
FIG. 8 depicts a backpack having a satellite system therein with a reflector unfolded in accordance with an aspect of the invention.
Figure 9:
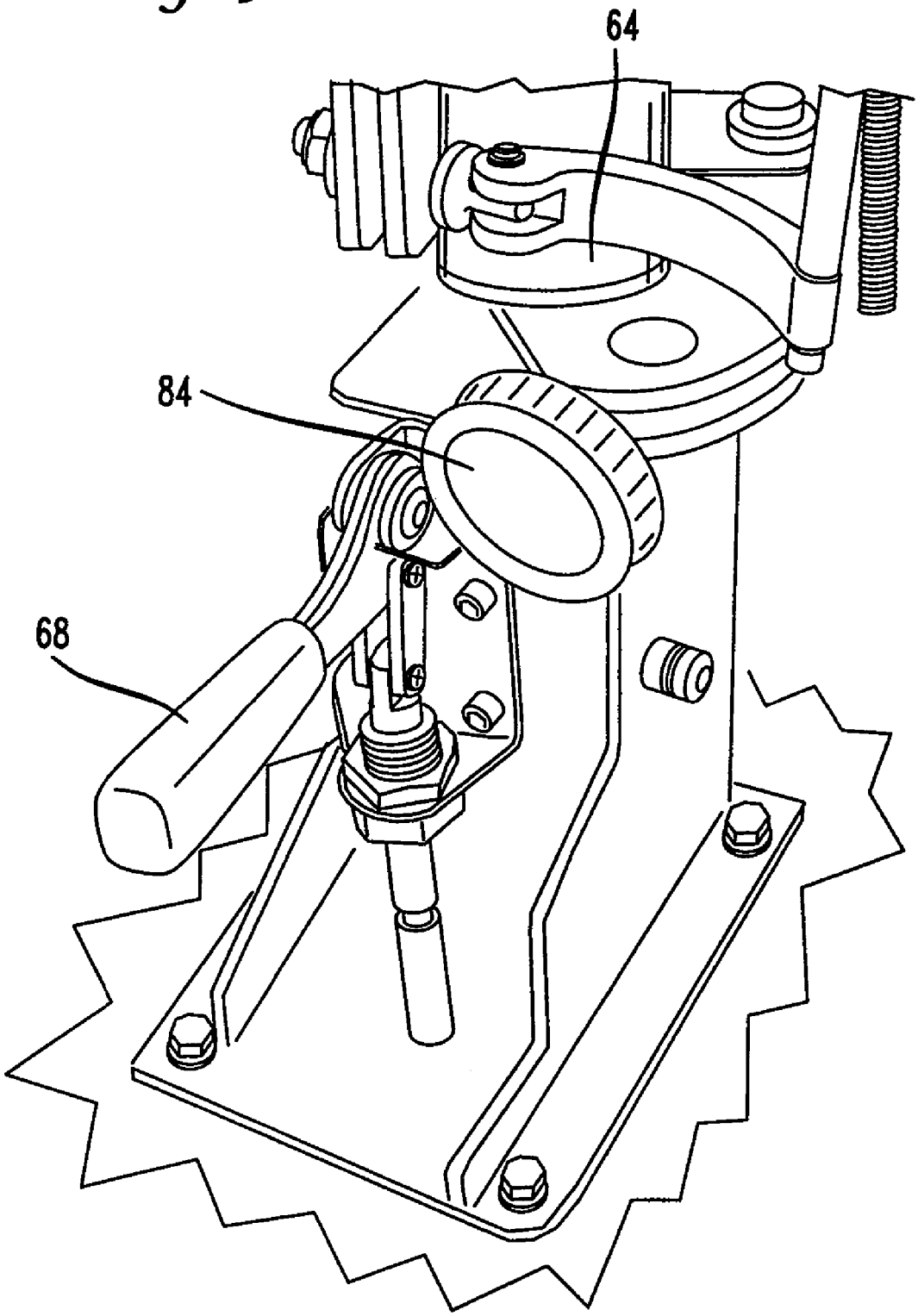
FIG. 9 depicts portions of a satellite system in accordance with an aspect of the invention.

FIG. 8 shows reflector 62 unfolded from the backpack, and ODU/LNB 66 and pole 64 within the backpack. FIG. 9 shows the pole 64 extended vertically from the backpack and locked in place with the vertical pole lock 68. Also shown is the fine azimuth control 84 of the satellite system.

Figure 10:
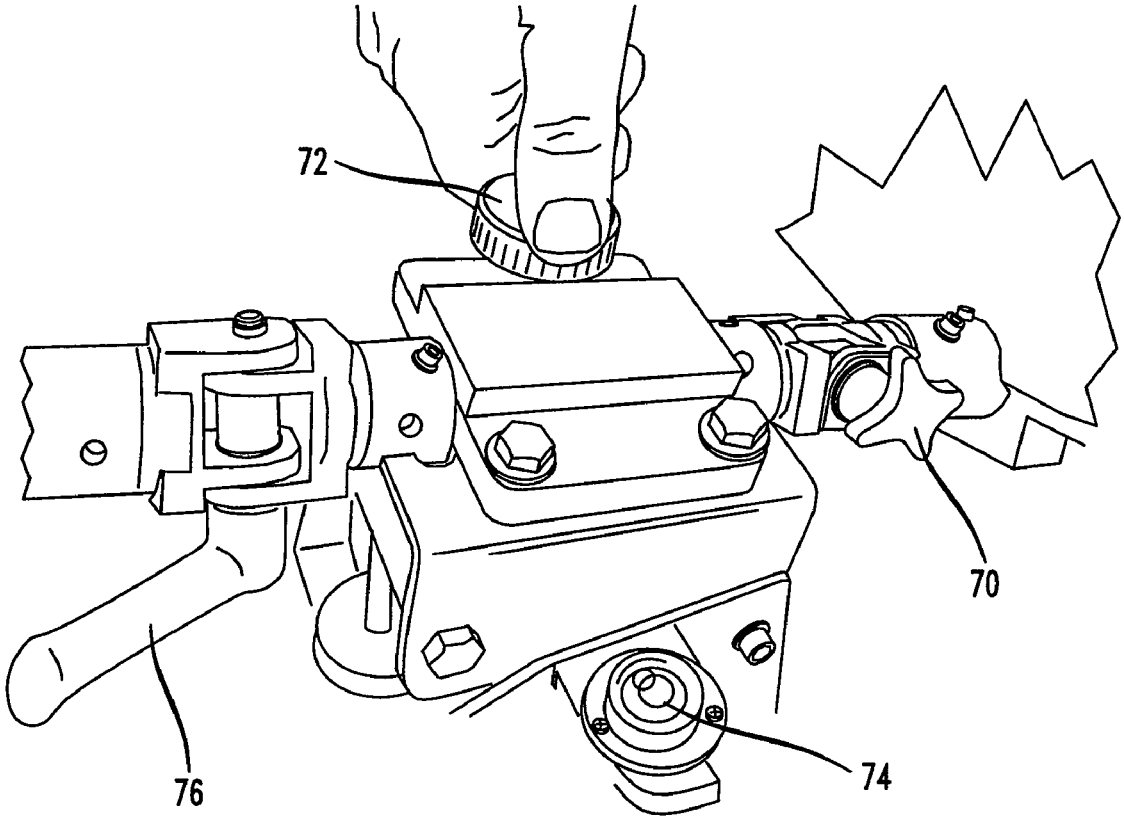
FIG. 10 depicts portions of a satellite system in accordance with an aspect of the invention.

FIG. 10 shows the ODU/LNB hinge and locking handle 76 for locking the ODU/LNB 66 into the operating or stowage positions. Also shown is a skew lock (typically a rotatable knob) 72 and level 74 as well as a reflector hinge and lock 70 for locking the reflector into the operating or stowage positions. Level 74 typically uses a bubble to determine whether the backpack support is in a level position. The level is used for pointing the antenna to the required satellite. For example, if you know the azimuth and elevation required, when system is leveled, the desired position can be reached more easily and accurately.

Figure 11:
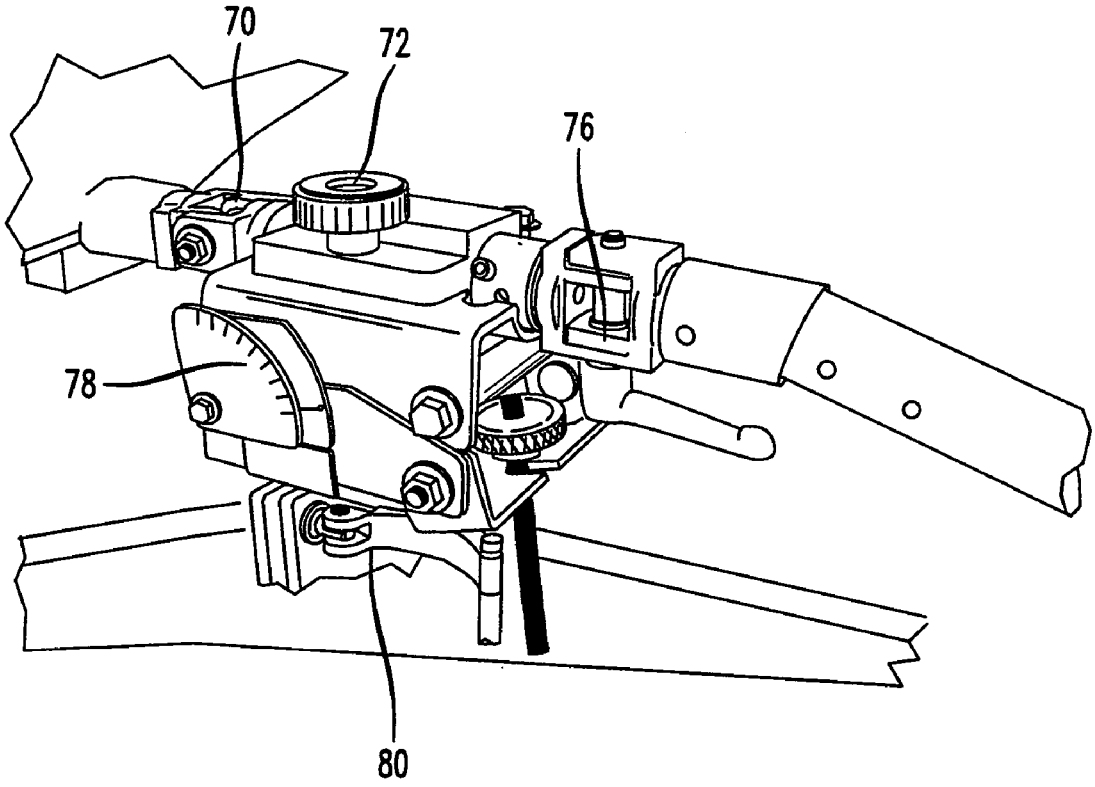
FIG. 11 depicts portions of a satellite system in accordance with an aspect of the invention.
Figure 12:
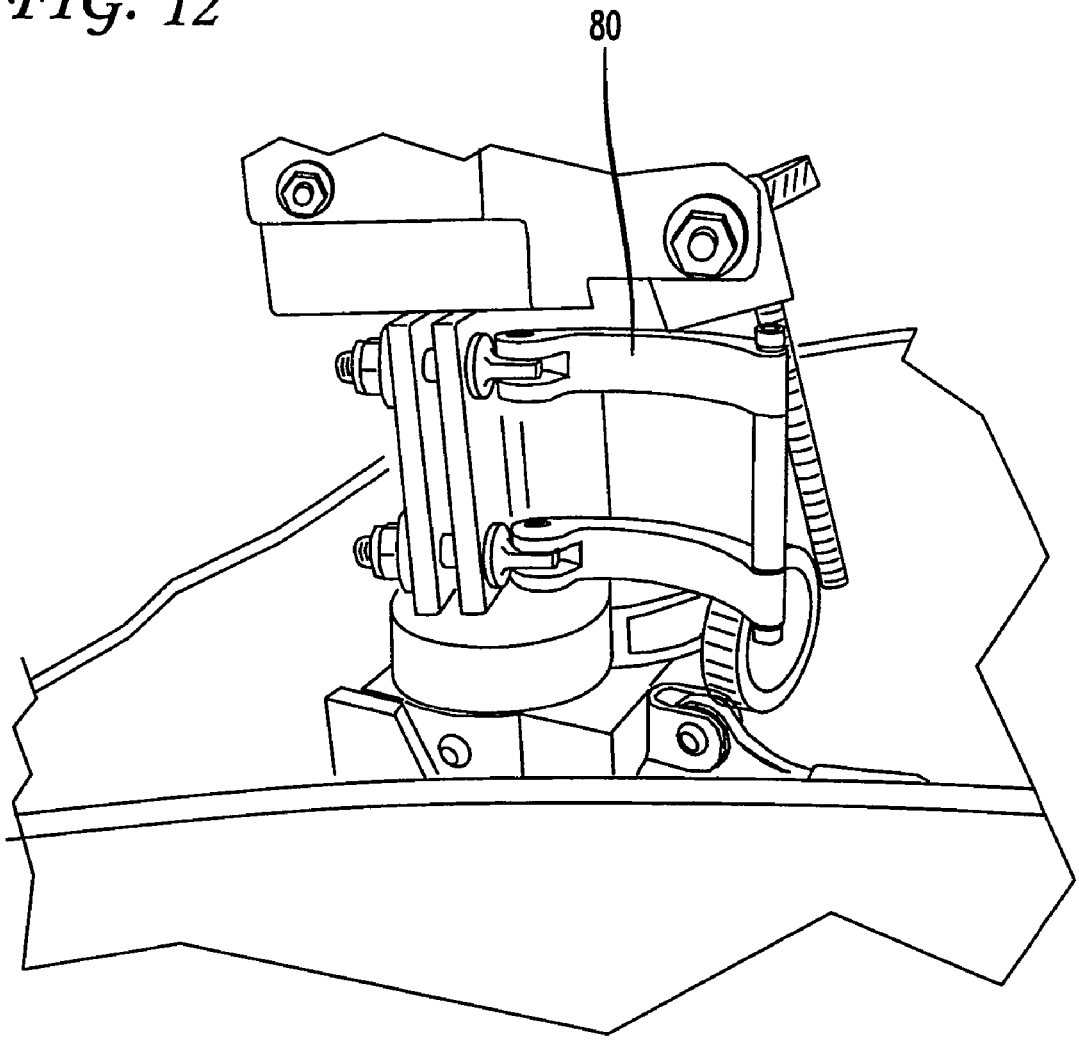
FIG. 12 depicts portions of a satellite system in accordance with an aspect of the invention.
Figure 13:
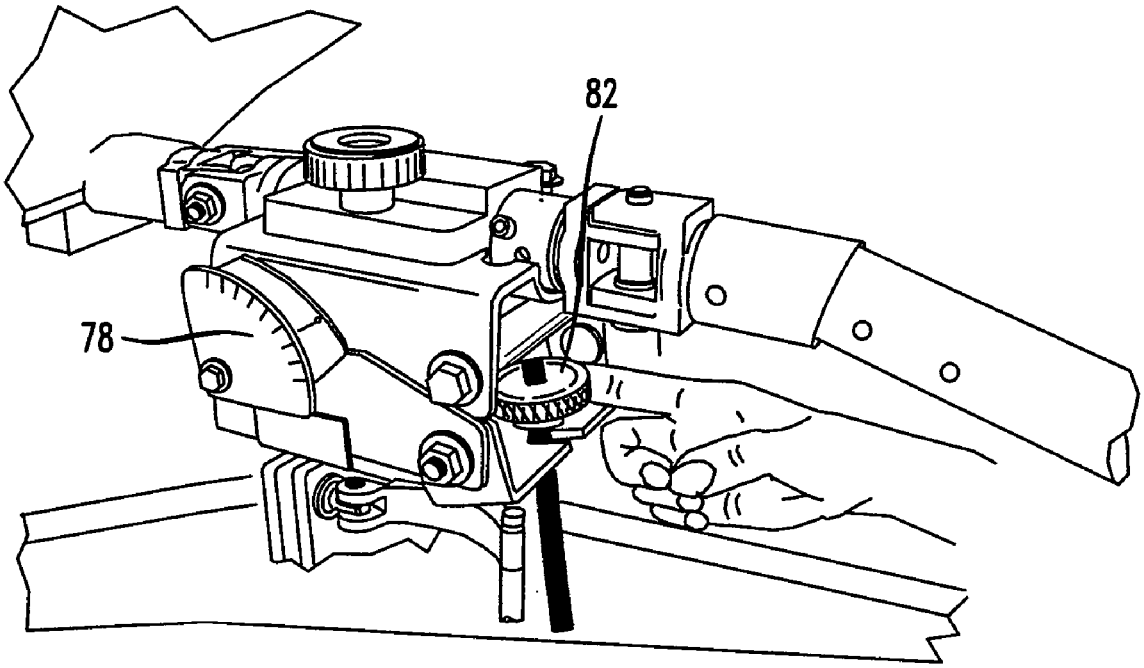
FIG. 13 depicts portions of a satellite system in accordance with an aspect of the invention.

FIG. 11 shows the ODU/LNB hinge and locking handle 76, skew lock 72, and reflector hinge and lock 70 from another angle. This figure also shows the coarse azimuth lock handle 80 and elevation scale 78 for operation of the satellite system. FIG. 12 shows a close up of the coarse azimuth 80 operable by moving the handle assembly shown. FIG. 13 shows the elevation scale 78 and the elevation adjustment 82 as a threaded knob to adjust the elevation.

Figure 14:
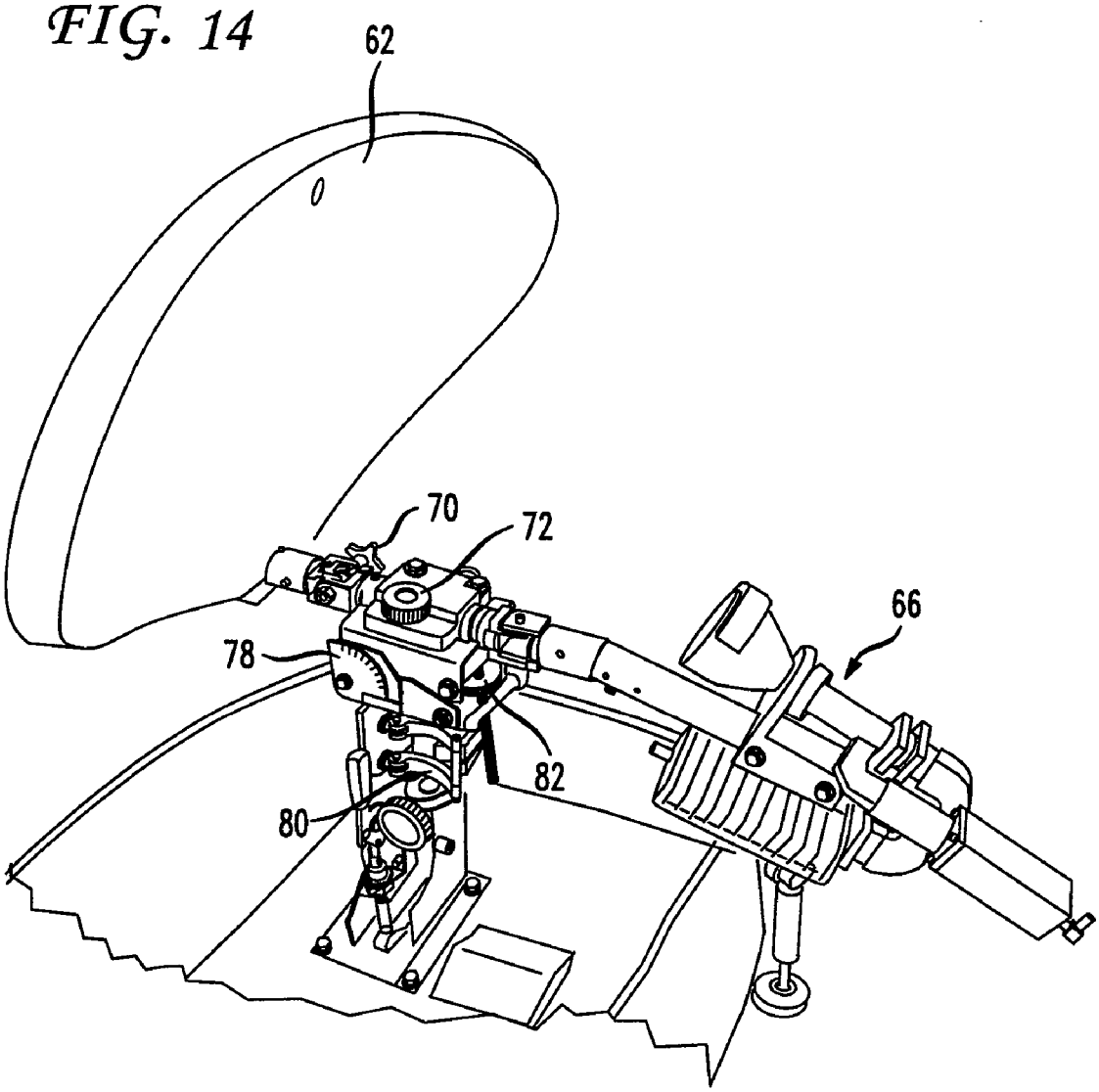
FIG. 14 depicts a satellite system unfolded from a backpack in accordance with an aspect of the invention.

FIG. 14 shows the antenna system unfolded from the backpack in an operating position.

Figure 15:
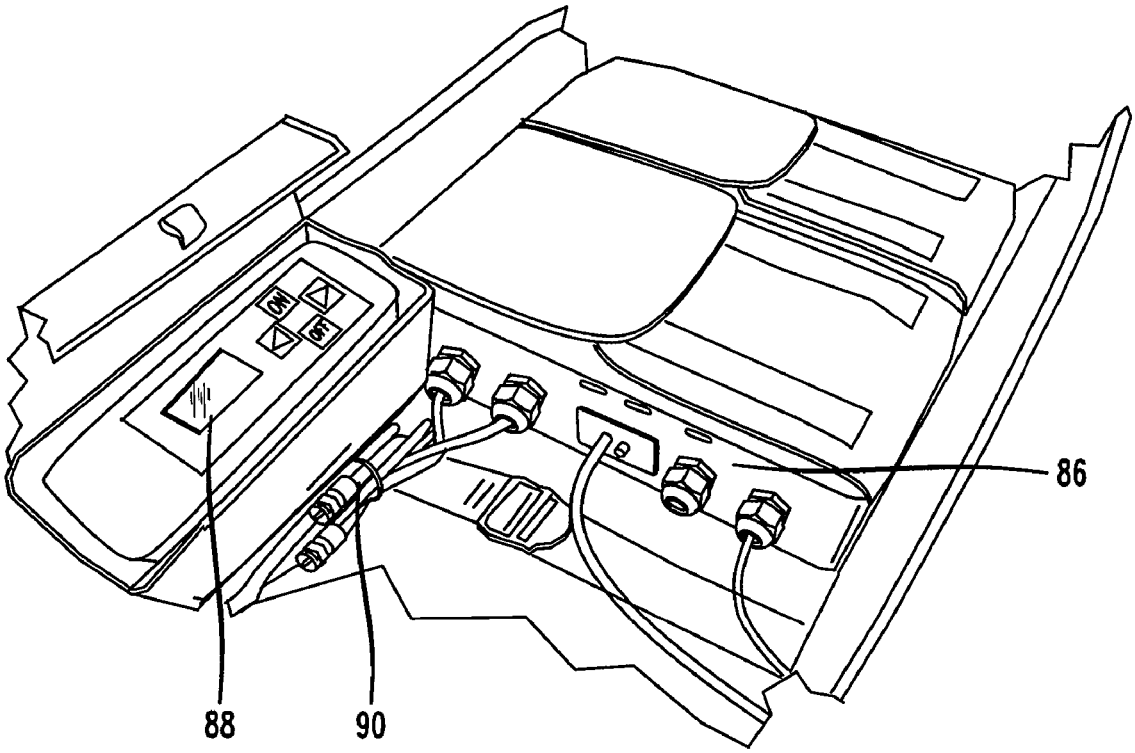
FIG. 15 depicts portions of a satellite system in accordance with an aspect of the invention.

FIG. 15 shows an outdoor VSAT unit 86 positioned in a pocket or compartment in the interior compartment of the backpack, a "SatPointer" 88 in another interior pocket and RF cables 90 for connecting the VSAT and ODU/LNB.

Figure 16:
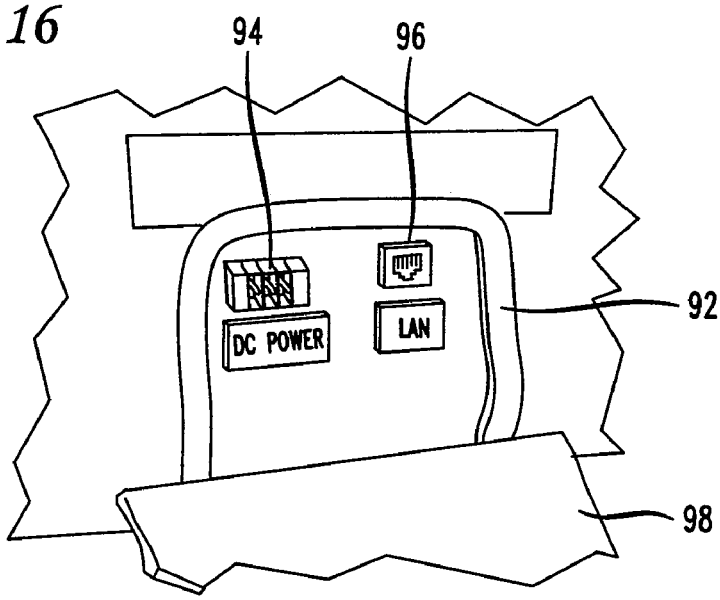
FIG. 16 depicts portions of a satellite system in accordance with an aspect of the invention.

FIG. 16 shows an inner side of the backpack having an opening for a connector panel such as connectors for DC power 94 and LAN 96. A flap 98 may cover this opening when not in use.

The antenna receiver may be in an extended position with cover replaced such that only the pole extends through the cover. This arrangement protects the internal equipment. Prior to closing the interior compartment with the cover, heavy objects, such as rocks or bricks, may be placed in the compartment to further stabilize the backpack and prevent strong winds from blowing the satellite system during use. A cloth or tarp type material may be placed in the compartment prior to adding the heavy objects to prevent dirt or other debris from contaminating the interior compartment. The material may be carried folded up in an exterior pocket.

In addition a cord, rope, or other means may be used to anchor the pole to the ground and prevent the wind from moving or knocking over the satellite system. The cord or rope may be contained in a retractable carrying case attached to the pole. A piton or other device may anchor the cord or rope to the ground.

Figure 17:
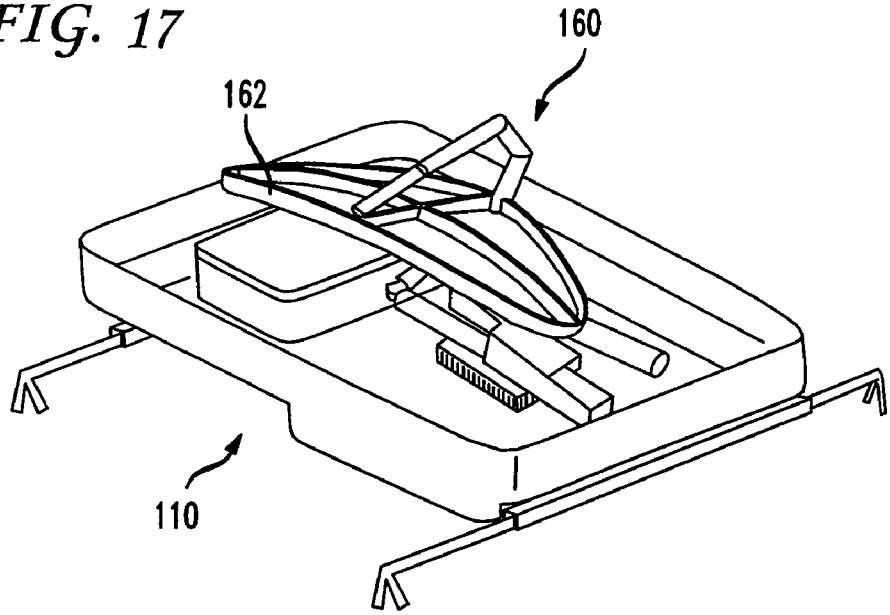
FIG. 17 depicts a satellite system in a folded position in accordance with an aspect of the invention.
Figure 18:
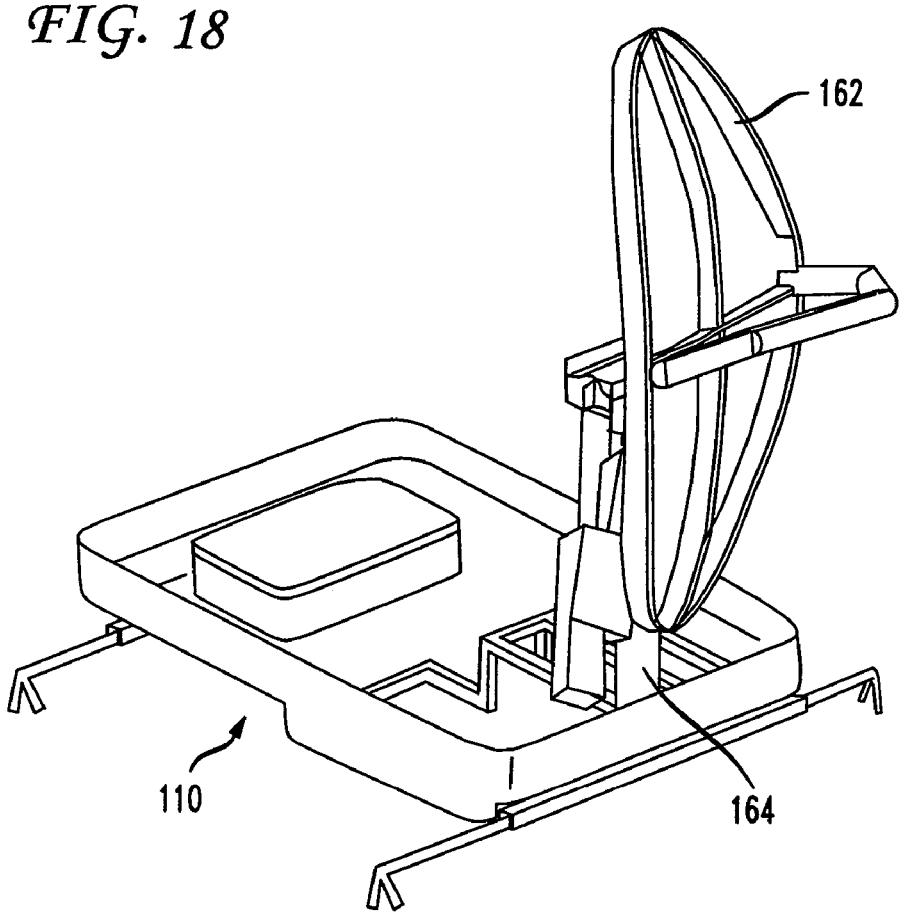
FIG. 18 depicts the satellite system of FIG. 17 with the pole set in a vertical position in accordance with an aspect of the invention.

FIGS. 17-21 depict the operation to set up the antenna system within the backpack base. FIG. 17 is the antenna system 160 in the stowage position with reflector 162 in a folded position in backpack 110. Note that FIG. 17 also shows an alternative leg assembly. FIG. 18 depicts the first step of unfolding the antenna system. Pole 164 is extended to a vertical position and secured in place.

Figure 19:
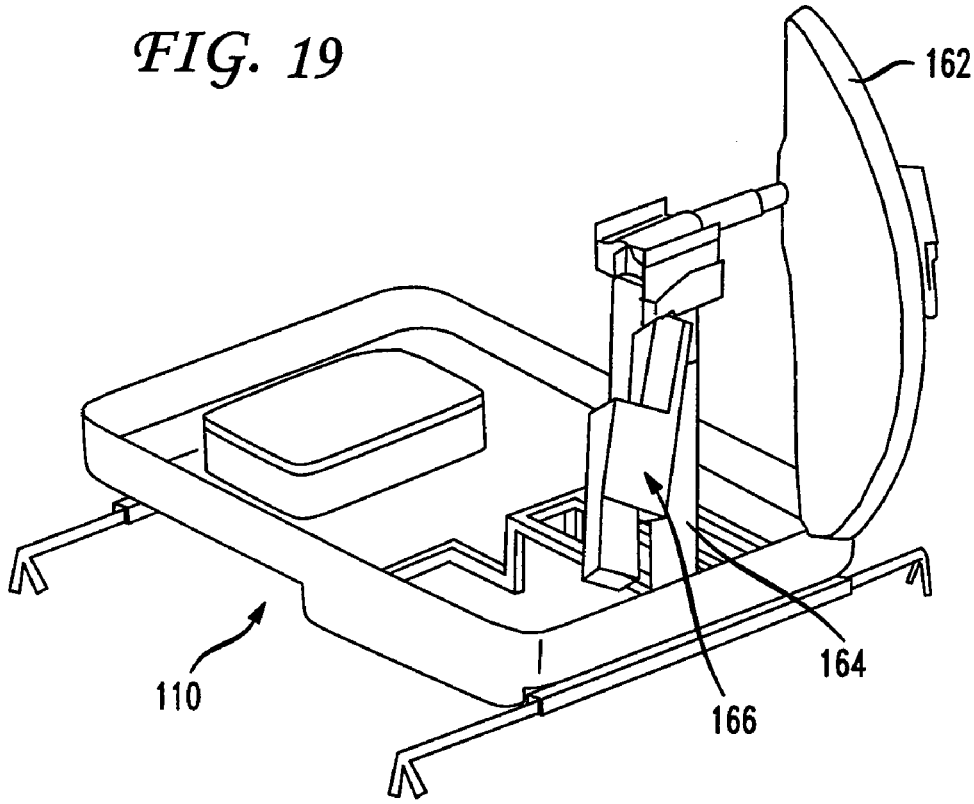
FIG. 19 depicts the satellite system of FIG. 18 with the reflector extended in accordance with an aspect of the invention.
Figure 20:
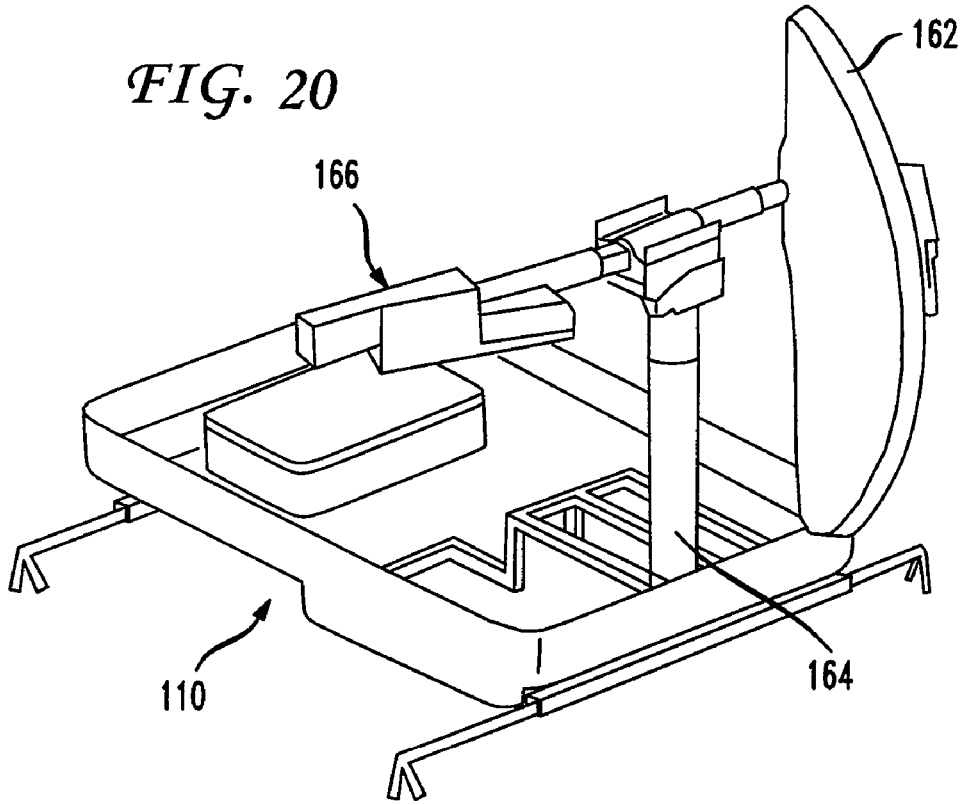
FIG. 20 depicts the satellite system of FIG. 19 with the ODU/LNB extended in accordance with an aspect of the invention.
Figure 21:
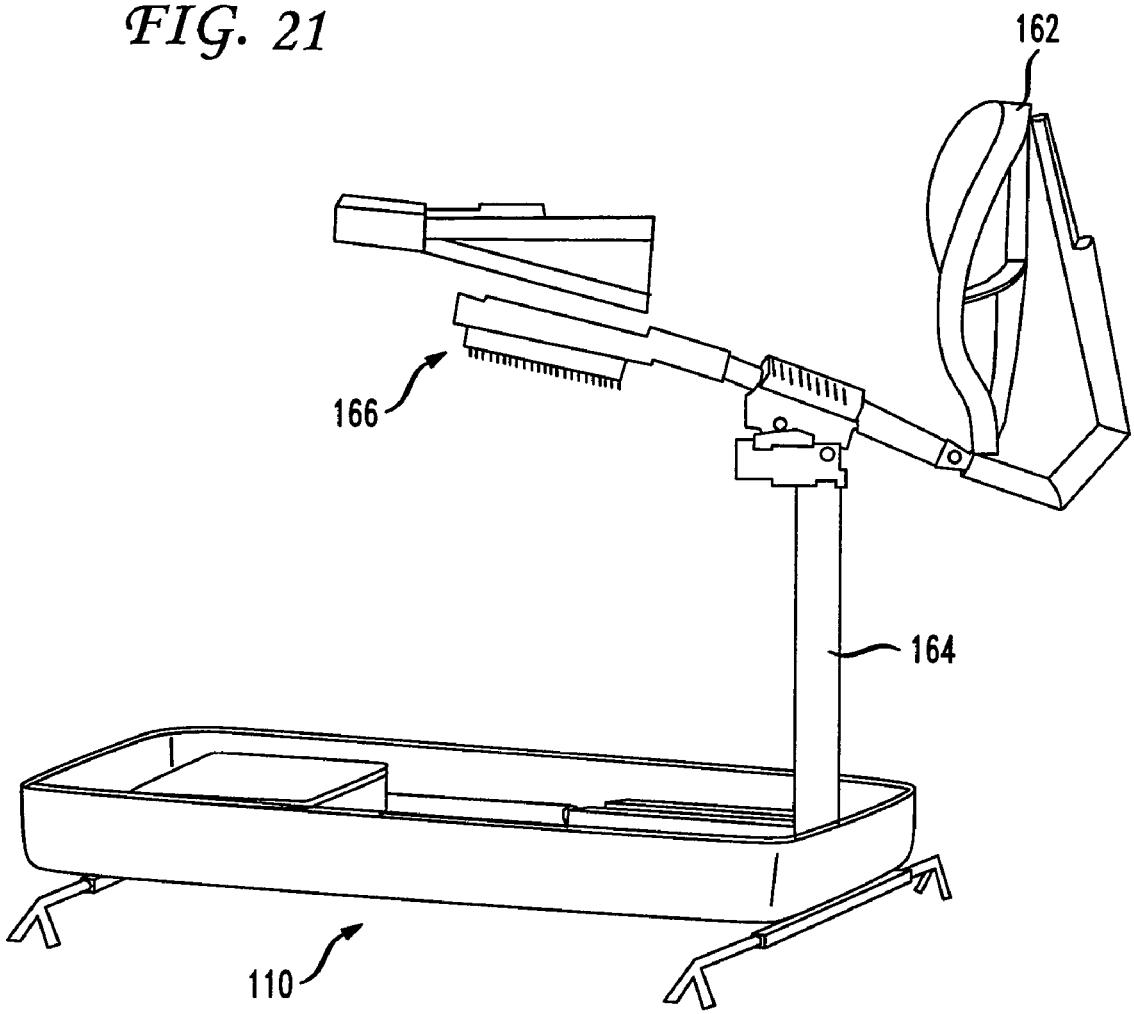
FIG. 21 depicts a fully employed satellite system in accordance with an aspect of the invention.

In a second step, as depicted in FIG. 19, the antenna reflector 162 is unfolded and secured, such as through a hinge and lock arrangement. In a third step, as depicted in FIG. 20, the ODU/LNB 166 is unfolded and secured in place, such as through a hinge and lock arrangement. FIG. 21 shows the satellite system 160 fully employed and ready for use. The skew is set, typically to zero, the elevation is adjusted, such as through an extending hinge arrangement, and the coarse azimuth and fine azimuth are adjusted. (See FIGS. 9-12 showing skew, elevation, coarse and fine azimuth controls/locks)

In order to stow the satellite assembly, the procedure is followed in the reverse order so as to fold in the ODU/LNB and antenna reflector, and then retract the pole and fold the antenna system to relocate in the backpack interior compartment.

The backpack weight including the antenna system is easily transportable by the wearer of the backpack. For example, a typical weight would be about 24 Kg which includes a 47 cm antenna, Armadillo VSAT, and the backpack itself.

While the invention has been described in connection with various example structures and illustrative aspects, it will be understood by those skilled in the art that other variations and modifications of the structures and aspects described above may be made without departing from the scope of the invention. Other structures and aspects will be apparent to those skilled in the art from a consideration of the specification or practice of the invention disclosed herein. It is intended that the specification and the described examples only are illustrative with the true scope of the invention.

We claim:

1. A quick deploy antenna system comprising, in combination:

a) a backpack body being wearable in a vertical position, the backpack body having an interior compartment; and leg assemblies extendible from the backpack body and extendible to a surface when the backpack is in a horizontal position, and b) a deployable antenna system contained within the interior compartment; wherein the antenna system is connected to the interior compartment and is extendible from the interior compartment into a fully deployed condition wherein the backpack body provides a base for deploying the antenna system.

2. The system of claim 1 wherein an outer side of the backpack body comprises reclosable flap wherein when the reclosable flap in an open position, the interior compartment is exposed.

3. The system of claim 2 wherein the reclosable flap is secured to the backpack body with at least one selected from a zipper, VELCRO, snaps, and buttons.

4. The system of claim 2 wherein the reclosable flap is secured along a bottom edge thereof to the backpack body.

5. The system of claim 1 further comprising a pair of shoulder straps connected at each end thereof to the backpack body; and a hip strap connected at opposite ends thereof to the backpack body.

6. The system of claim 1 further comprising a cover deployable over the shoulder straps and hip strap to cover the shoulder straps and hip strap when the backpack body is in the horizontal position.

7. The system of claim 1 wherein the leg assemblies each comprise an extension bar connected to the backpack body at one end wherein the extension bar extends from and retracts into the backpack.

8. The system of claim 7 wherein a leg support is attached to each extension bar at an end other than the end connected to the backpack body, wherein the leg support is connected to the extension bar in a rotatable manner.

9. The system of claim 8 wherein when the backpack body is in a horizontal position, each leg extension bar extends horizontally from the backpack body and the leg support is rotated vertically to contact a surface in order to support the backpack body against the surface.

10. The system of claim 9 wherein the antenna system comprises a pole wherein the pole is connected to the interior compartment and is in a horizontal position when stowed and in a vertical position when deployed.

11. The system of claim 10 wherein an antenna reflector is connected to the pole and is foldable against the pole during stowage and unfoldable from the pole for operating the antenna system.

12. The system of claim 10 wherein an ODU/LNB is connected to the pole and is foldable against the pole during stowage and unfoldable from the pole for operating the antenna system.

13. The system of claim 12 wherein the pole and ODU/LNB are connected by at least one hinge or other suitable connector.

14. The system of claim 11 wherein the pole and antenna reflector are connected by at least one hinge or other suitable connector.

15. The system of claim 14 wherein the antenna system comprises several parts connected together and foldable into the backpack body.

16. The system of claim 15 wherein at least two of the several parts are connected together by one or more hinges or other suitable connectors.

17. The system of claim 15 wherein the several parts include an antenna reflector, an ODU/LNB, and a pole.

18. The system of claim 1 wherein the backpack body further comprises wheels.

19. A method of deploying an antenna system from a backpack body, the backpack body having an interior compartment and leg assemblies extendible from the backpack body to a surface when the backpack body is in a horizontal position, wherein the antenna system is connected to the interior compartment, the method comprising a) placing the backpack body in a horizontal position on the surface, and b) deploying the antenna system from within the interior compartment;

wherein the backpack body provides a base for deploying the antenna system.

20. The method of claim 19 wherein the leg assemblies each comprise an extension bar connected to the backpack at an end wherein the extension bar extends from and retracts into the backpack body, wherein prior to deploying the antenna system, the method further comprising extending the extension bar of each leg assembly.

21. The method of claim 20 wherein a leg support is attached to each extension bar at an end other than the end connected to the backpack body, wherein the leg support is connected to the extension bar in a rotatable manner, the method further comprising rotating the leg support to make contact with a ground surface.

22. The method of claim 19 further comprising deploying the antenna system by extending a pole connected to the interior of the backpack body and unfolding a reflector from the extended pole.

* * * * *